US007513567B2

(12) United States Patent
Huang

(10) Patent No.: US 7,513,567 B2
(45) Date of Patent: Apr. 7, 2009

(54) FOLDABLE CHAIR WITH PULL RODS

(76) Inventor: Tsung-Chieh Huang, 235 Chung - Ho Box 8-24, Taipei (TW)

( * ) Notice: Subject to any disclaimer, the term of this patent is extended or adjusted under 35 U.S.C. 154(b) by 175 days.

(21) Appl. No.: 11/416,428

(22) Filed: May 3, 2006

(65) Prior Publication Data

US 2007/0257524 A1 Nov. 8, 2007

(51) Int. Cl.
*A47C 4/00* (2006.01)

(52) U.S. Cl. ..... 297/16.1; 297/452.63; 297/440.2; 297/248

(58) Field of Classification Search ..... 297/452.63, 297/440.2
See application file for complete search history.

(56) References Cited

U.S. PATENT DOCUMENTS 3,658,382 A * 4/1972 Anderson ..... 297/451.8
5,967,605 A * 10/1999 Stanfield ..... 297/239
6,206,469 B1 * 3/2001 Caruso et al. ..... 297/248
6,338,587 B1 * 1/2002 Kuo ..... 403/109.7
6,669,281 B1 * 12/2003 Huang ..... 297/58

* cited by examiner

*Primary Examiner*—Katherine W Mitchell
*Assistant Examiner*—Philip S Kwon

(57) ABSTRACT

A foldable chair with pull rods comprises a front supporter, a back supporter; wherein a width of the front supporter is smaller than that of the back supporter; the back supporter being installed to the front supporter by using two pull rods; a seat pivotally installed to the back supporter and the front supporter; and a back cushion assembled to upper ends of the front supporter. The back supporter has two legs, an upper side of each leg of the back supporter is installed with a first engaging unit, and a second engaging unit, and each engaging unit has a hole for receiving a respective one of the two pull rods. The first engaging unit has a first hook. The second engaging unit has a second hook engageable to the first hook. Each pull rod has a head; and an upper side of the head is a convex cambered area.

1 Claim, 7 Drawing Sheets

FOLDABLE CHAIR WITH PULL RODS

FIELD OF THE INVENTION

The present invention relates to chairs, and in particular to a foldable chair with pull rods, wherein a width of the back supporter of the chair is smaller than that of the back supporter thereof, in stacking, the front supporter can be placed into the back supporter. Thereby the width of the chair is reduced and the space for storing the chair is smaller. Furthermore, it has a steady structure when the user leans against the back cushion.

BACKGROUND OF THE INVENTION

Chairs are necessary furniture. Thereby the comfortable design of the chair is needed. However the prior art chair has the following disadvantages.

The width of the front legs is identical to that of the back legs. After the chair is folded, the width of the chair is equal to the widths of the front and back legs, which occupies a great space. Furthermore, since the width of the front legs is equal to that of the back legs. The stability needs to be increased. Generally, the pivotal head of a pull rod is connected to a telescopic rod through a neck portion. As a result, the volume of the pull rod is greater. To have a stable structure in stacking chairs, the front lower edge of the pivotal head of the pull rod has a positioning groove. A rear end thereof is installed with a positioning protrusion. The structure is complicated and the volume increases. The width of the chair is equal to the widths of the front and back legs. In stacking, the pivotal head of the pull rod and the positioning protrusion are used so that a great space is necessary. In assembling the back cushion and the front legs, the elastic buckles installed at assembly chambers at two sides of the back cushion are fixed to the upper ends of the front legs. The assembly work is time consumed and laborious. Thereby the mechanic fatigue of the elastic buckles will make the structure of the chair loose.

SUMMARY OF THE INVENTION

Accordingly, the primary object of the present invention is to provide a foldable chair with pull rods, wherein a width of the back supporter is smaller than that of the back supporter, in stacking, the front supporter can be placed into the back supporter. Thereby the width of the chair is reduced and the space for storing the chair is smaller. Furthermore, it has a steady structure, when the user leans against the back cushion.

To achieve above objects, the present invention provides a foldable chair with pull rods which comprises a front supporter; a back supporter; wherein a width of the front supporter is smaller than that of the back supporter; the back supporter being installed to the front supporter by using two pull rods; a seat; pivotally installed to the back supporter and the front supporter; a back cushion assembled to upper ends of the front supporter. The back supporter has two legs; an upper side of each leg of the back supporter is installed with a first engaging unit, and a second engaging unit; each engaging unit has a hole for receiving a respective one of the two pull rods. The first engaging unit has a first hook. The second engaging unit has a second hook engageable to the first hook. Each pull rod has a head; an upper side of the head is a convex cambered area; and a stop is installed at a topside of the head.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
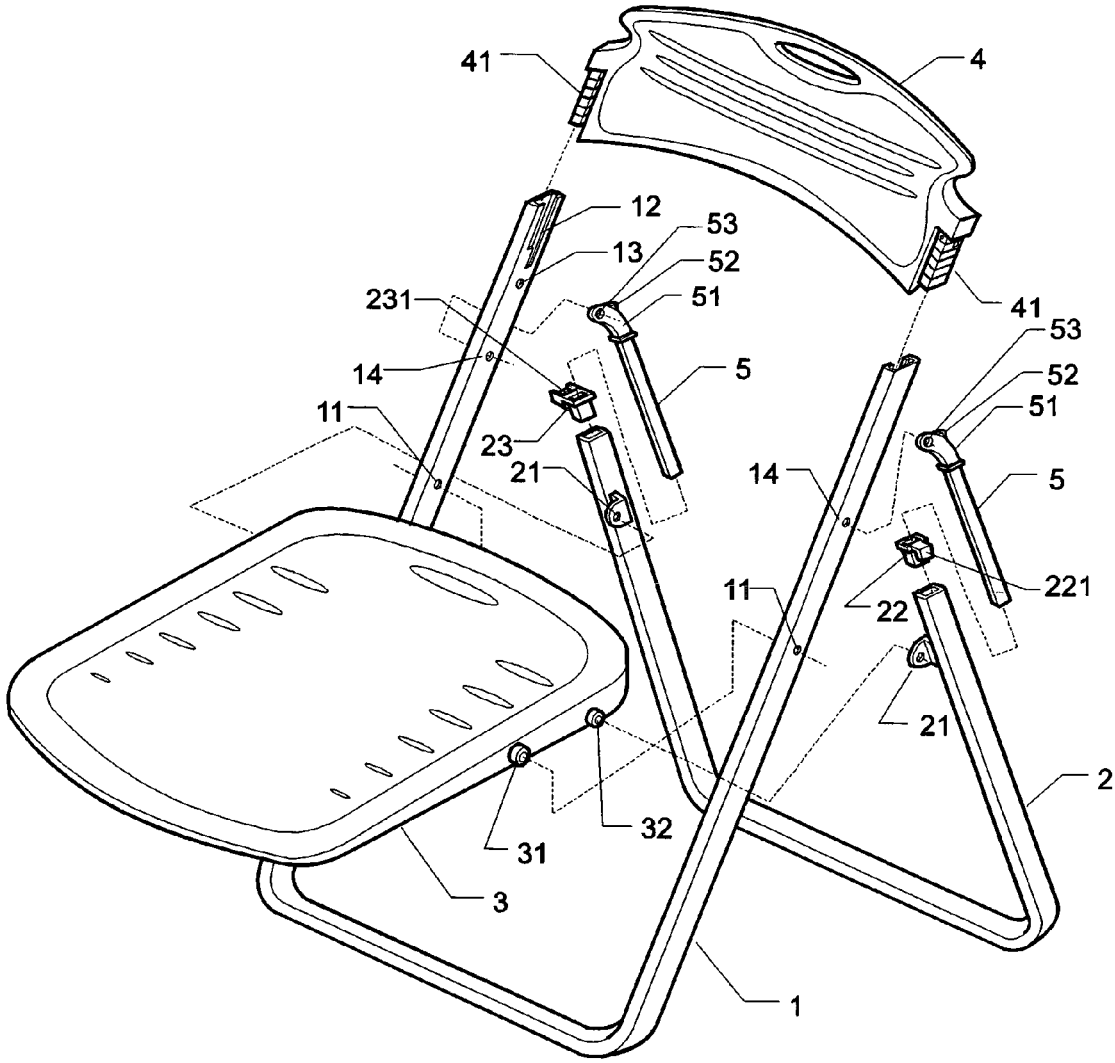
FIG. 1 is an assembled schematic view of the present invention.
Figure 2:
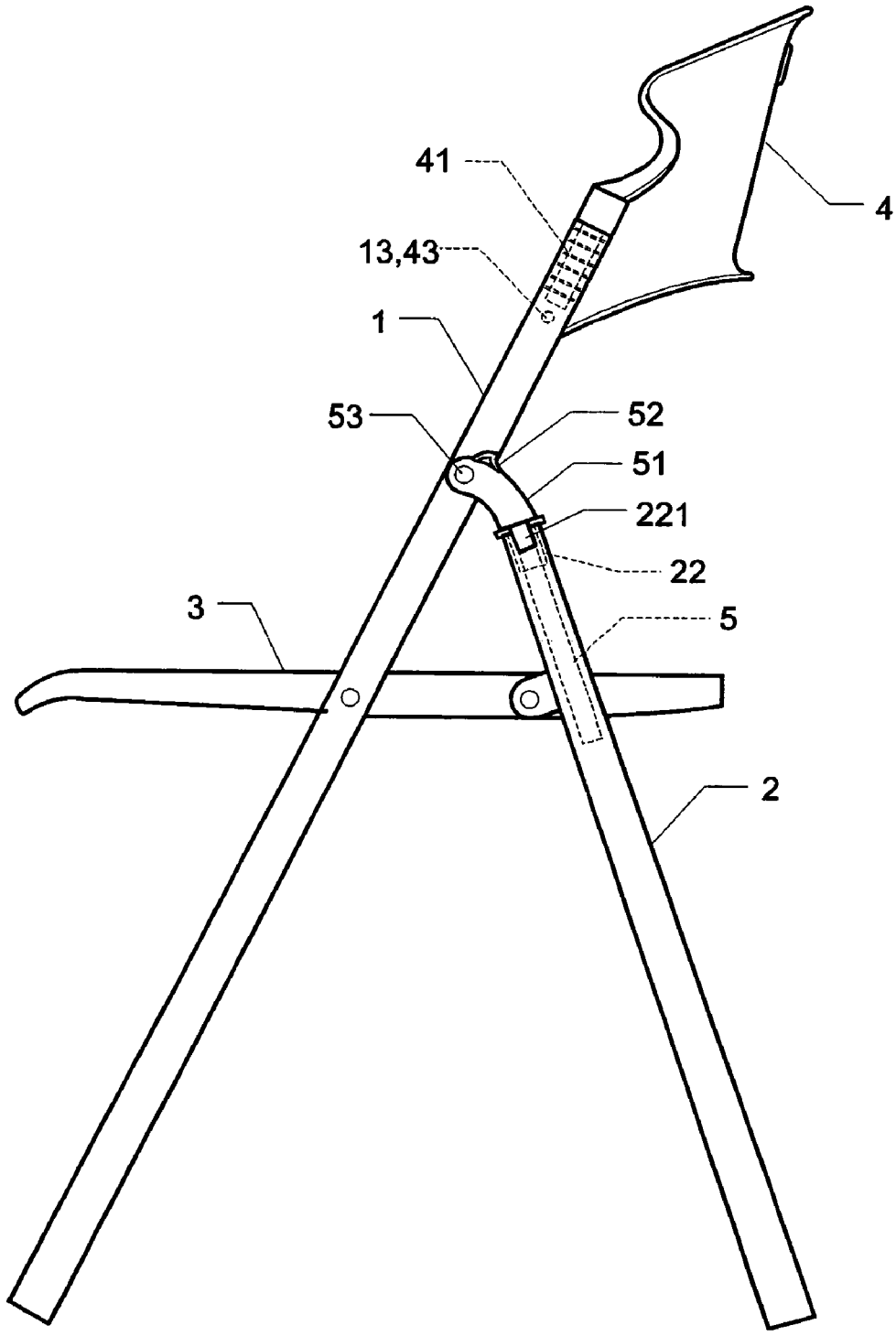
FIG. 2 is an expanded view of the chair of the present invention.
Figure 3:
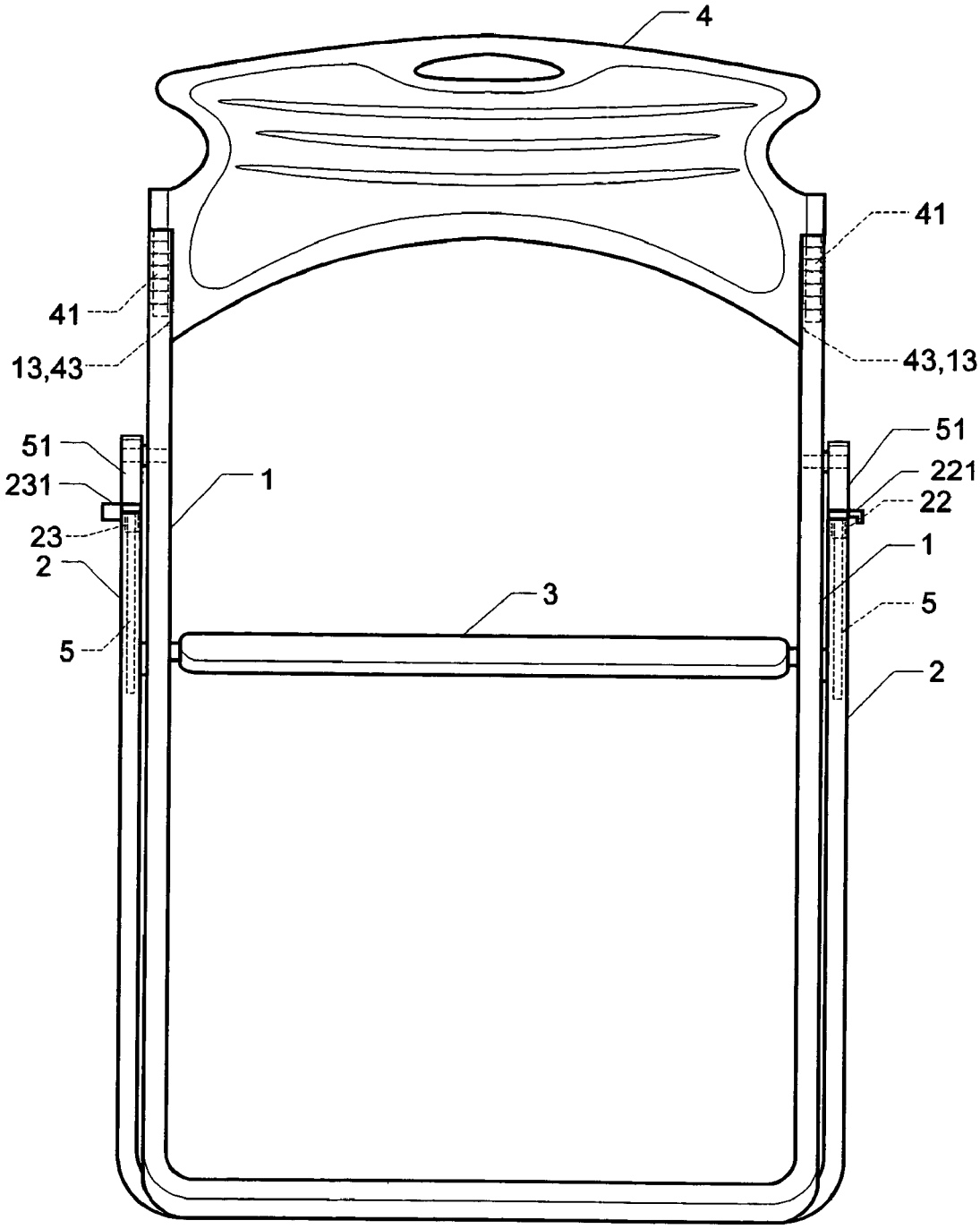
FIG. 3 is a front view of the chair of the present invention.
Figure 4:
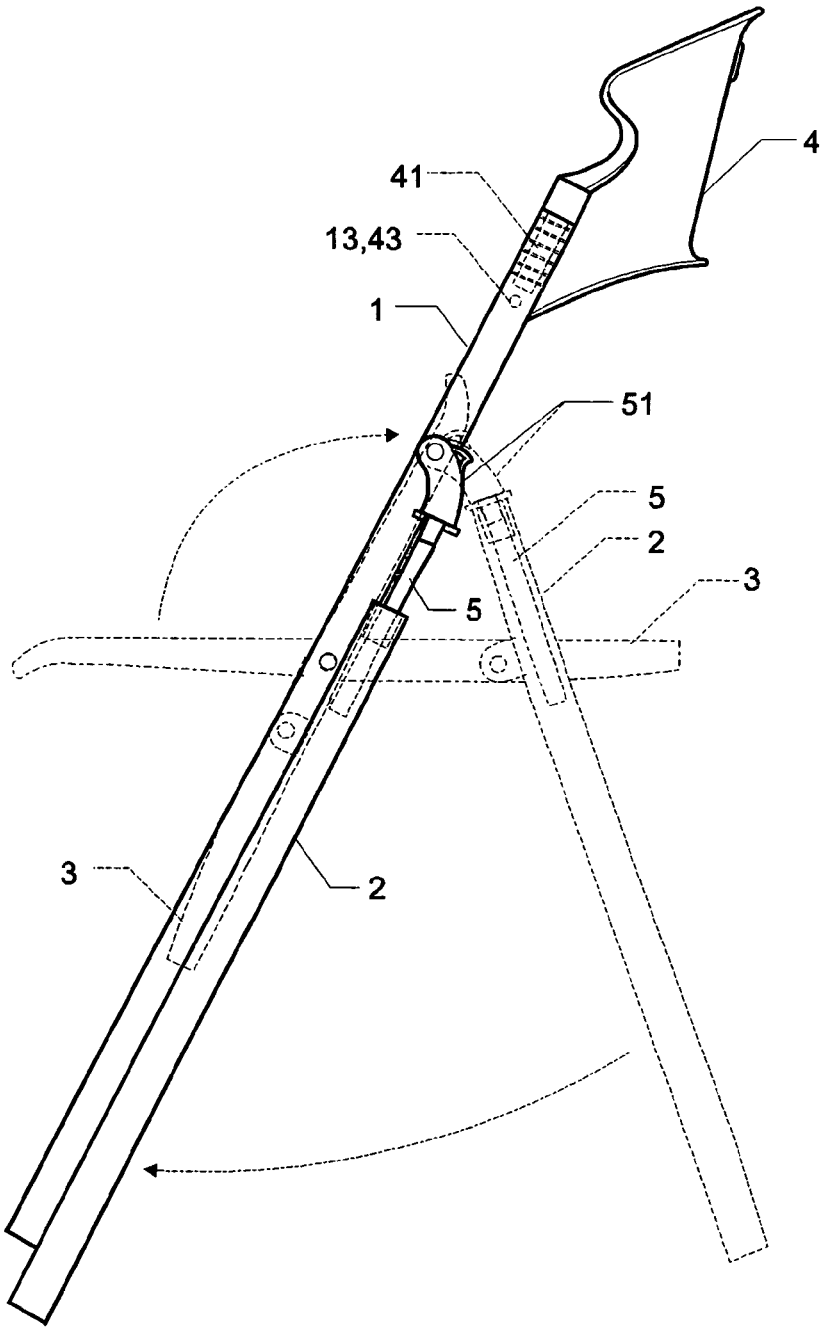
FIG. 4 is a schematic view about the folded state of the chair of the present invention.
Figure 5:
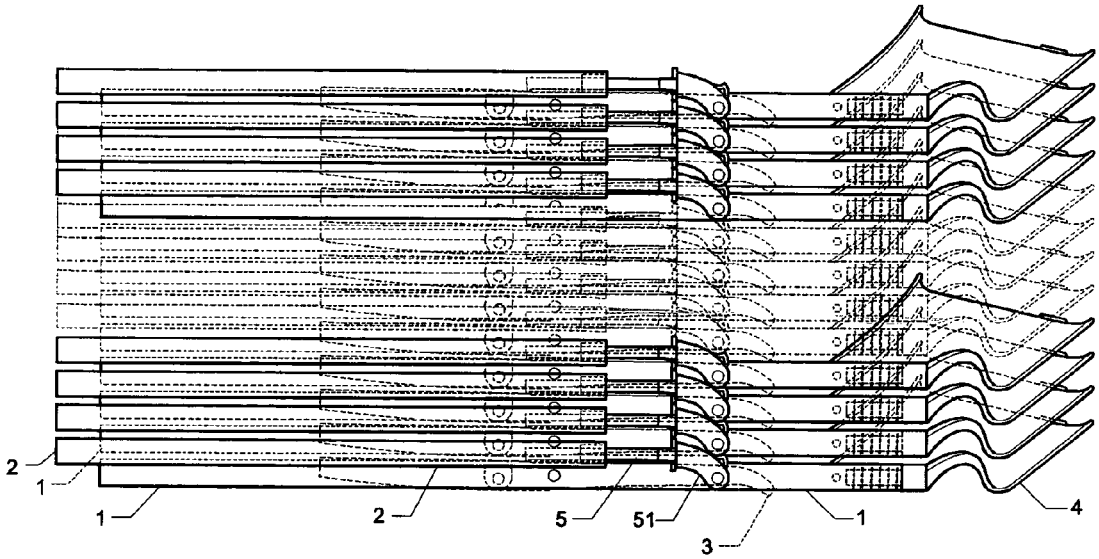
FIG. 5 is a schematic view about the stacking form of the present invention.

Referring to FIG. 1, the present invention is illustrated. The present invention has the following elements.

A front supporter 1 has a U shape. The front supporter 1 has two legs at two sides. A middle section of each of the legs of the front supporter 1 has an assembly hole 11. An upper side of each of the legs of the front supporter 1 has a notch 12 at an inner side thereof. A buckling hole 13 at an inner side of each leg and below the notch 12. A penetrating hole 14 is installed below the buckling hole 13.

A back supporter 2 has a U shape. The back supporter 2 has two legs. An upper side of each leg of the back supporter 2 has an ear 21. An upper end of each leg of the back supporter 2 is installed with a first engaging unit 22, and a second engaging unit 23.

Figure 15:
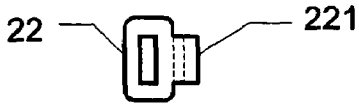
FIG. 15 is an elevational view of FIG. 13.
Figure 13:
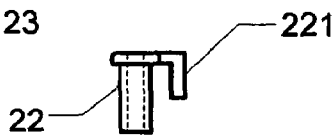
FIG. 13 shows another engaging unit of the present invention.
Figure 14:
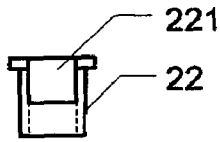
FIG. 14 shows the right lateral view of FIG. 13.

Referring to FIGS. 13 to 15, the first engaging unit 22 has a hook 221 at one side thereof.

Figure 12:
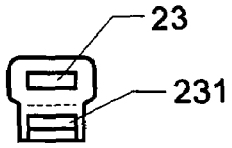
FIG. 12 shows the elevational view of FIG. 10.
Figure 10:
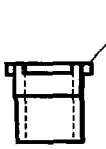
FIG. 10 shows the engaging unit of the present invention.
Figure 11:
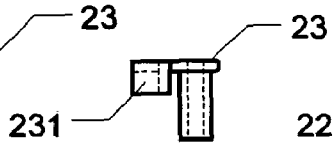
FIG. 11 shows the right lateral view of the FIG. 10.

Referring to FIGS. 10 to 12, the second engaging unit 23 has a hook 231 at one side thereof. Different chairs can be connected one by one by the engagements of the engaging units 22, 23.

Each of the first and second engaging units 22, 23 has a through hole, and in assembling state, each of the first and second engaging units 22, 23 is inserted into a through hole in an upper side of a respective leg of the back supporter 2. The hook 221, 231 of each of the first and second engaging units 22, 23 protrudes out of the respective leg.

Figure 9:
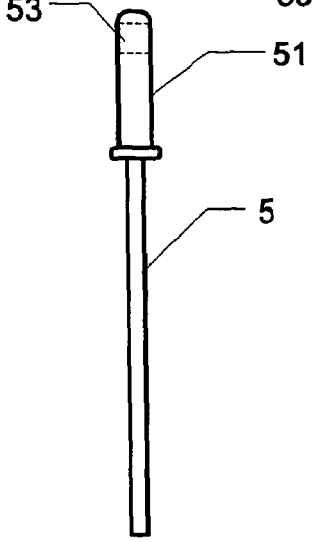
FIG. 9 is a left lateral view of FIG. 8.
Figure 8:
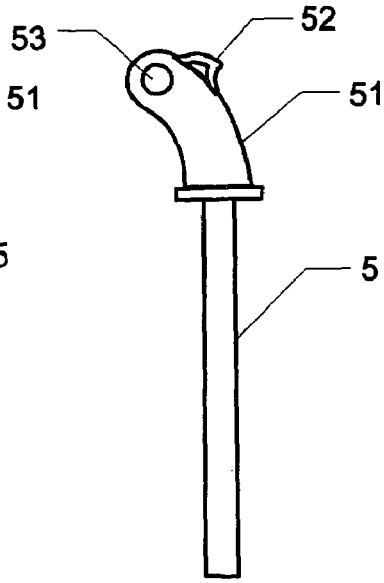
FIG. 8 shows the pull rod of the present invention.

Two pull rods 5 are included, as shown in FIGS. 8 and 9. Each pull rod 5 has a head 51. An upper side of the head 51 is a convex cambered area. A stop 52 is installed at a topside of the head 51. The head 51 has a pivotal hole 53. The lower side of the pull rod is inserted into a hole in the engaging unit and then into the leg of the back supporter 2. A river is inserted through the pivotal hole 53 and the penetrating hole 14 so as to assembly the back supporter 2 to the front supporter 1.

Figure 6:
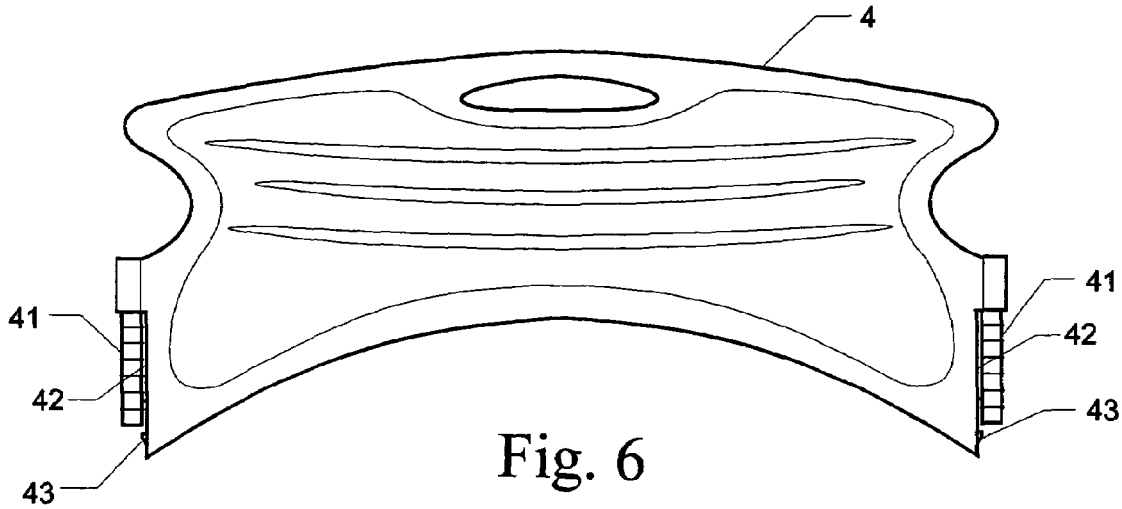
FIG. 6 shows the back cushion of the chair of the present invention.
Figure 7:
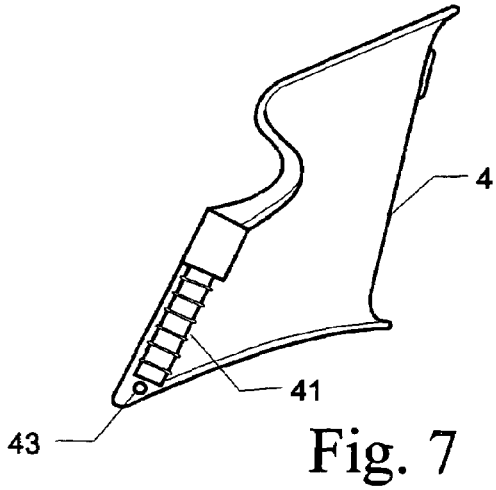
FIG. 7 is a right lateral view of FIG. 6.

A back cushion 4, as shown in FIGS. 1, 6 and 7, has inserting rods 41 at two sides. The inserting rods 41 are adhered to the connecting walls 42 of the back cushion 4. A lower edge of each wall 42 has a buckle 43 which is buckled into the buckling hole 13 below the notch 12 of the leg of the front supporter 1. In assembly, the inserting rods 41 of the back cushion 4 are inserted into the notches 12 of the front supporter 1 so as to assembly the front supporter 1 to the back cushion 4.

A seat 3 is included. Each lateral side of the seat has a front post 31 which is inserted into the assembly hole 11 of the front supporter 1 and a rear post 32 which is inserted into a hole in the car 21 of the back supporter 2 so as to assembly the front supporter 1 and the back supporter 2 to the seat 3.

Referring to FIGS. 2 to 5, it is illustrated that the width of the front supporter 1 is smaller than that of the back supporter 2. By the pull rod 5, after folding, the width of folded chair is smaller that the summation of the width of the front supporter 1 and the width of the back supporter 2 (referring to FIG. 4). Besides, in assembly, the inserting rods 41 of the back cushion 4 are inserted into the notches 12 of the front supporter 1 so as to assembly the front supporter 1 to the back cushion 4. No screw or rivet is necessary in assembly.

Advantages of the present invention will be described herein. The width of the back supporter 2 is smaller than that of the back supporter 2, in stacking, the front supporter 1 can be placed into the back supporter 2. Thereby the width of the chair is reduced and the space for storing the chair is smaller. Furthermore, it has a steady structure, when the user leans against the back cushion. The assembly work of the present invention can be performed rapidly and simply.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A foldable chair with pull rods comprising:

a front supporter (1) having a U shape; the front supporter (1) having two legs at two sides; a middle section of each of the legs of the front supporter (1) having a respective assembly hole (11); an upper side of each of the legs of the front supporter (1) having a respective notch (12) at an inner side thereof; a respective buckling hole (13) being at an inner side of each leg and below the notch (12) thereof; a respective penetrating hole (14) being installed below a respective one of the buckling holes (13);

a back supporter (2) having a U shape; the back supporter (2) having two legs; an upper side of each leg of the back supporter (2) having a respective ear (21); upper ends of legs of the back supporter (2) being installed with a first engaging unit (22) and a second engaging unit (23) respectively; each of the first and second engaging units (22, 23) having a respective through hole; and the first engaging unit (22) being extended with a first hook (221) at one side thereof; the second engaging unit (23) being extended with a second hook (231) at one side thereof; in assembling state, each of the first and second engaging units (22, 23) being inserted into a respective second through hole in an upper side of a respective leg of the back supporter (2); and the respective first and second hooks (221, 231) of the first and second engaging units (22, 23) protruding out of the respective leg;

two pull rods (5); each pull rod (5) having a respective head (51); an upper side of each head (51) being a convex cambered area; a topside of each head (51) being installed with a respective stop (52); each head (51) having a respective pivotal hole (53); a lower side of each pull rod being inserted into the respective through hole in the engaging unit (22) and then into a respective one of the legs of the back supporter (2); a respective rivet being inserted through the respective pivotal hole (53) and the respective penetrating hole (14) so as to assembly the back supporter (2) to the front supporter (1);

a back cushion (4) having two inserting rods (41) installed at two opposite lateral walls (42) thereof and extending downwards from two protrusions at two lateral walls (42), respectively; a lower edge of each wall (42) protruding with a buckle (43) which is buckled into the respective buckling hole (13) below the respective notch (12) of the respective leg of the front supporter (1); in assembly, the inserting rods (41) of the back cushion (4) being inserted into the notches (12) of the front supporter (1) so as to assembly the front supporter (1) to the back cushion (4);

a seat (3); each of two lateral sides of the seat having a respective front post which is inserted into the respective assembly hole (11) of the front supporter (1) and a respective rear post (32) which is inserted into a hole in the respective ear (21) of the back supporter (2) so as to assembly the front supporter (1) and the back supporter (2) to the seat (3); and wherein a width of the front supporter (1) is smaller than a width of the back supporter (2); by the pull rods (5), after folding, a width of folded chair is smaller than the summation of the width of the front supporter (1) and the width of the back supporter (2);

wherein, in assembly, the inserting rods (41) of the back cushion (4) are inserted into the notches (12) of the front supporter (1) so as to assemble the front supporter (1) to the back cushion (4).

* * * * *